US005836618A

United States Patent [19]

Perlman

[11] Patent Number: 5,836,618

[45] Date of Patent: Nov. 17, 1998

[54] STRETCHABLE THERMOPLASTIC LABELS FOR CRYOGENIC STORAGE CONTAINERS

[75] Inventor: Daniel Perlman, Arlington, Mass.

[73] Assignee: Brandeis University, Waltham, Mass.

[21] Appl. No.: 746,053

[22] Filed: Nov. 6, 1996

[51] Int. Cl.[6] ..... B42D 15/00

[52] U.S. Cl. ..... 283/70; 283/81; 283/101

[58] Field of Search ..... 283/67, 70, 81, 283/101, 107, 117; 40/299; 128/DIG. 27; 220/901; 285/904

[56] References Cited

U.S. PATENT DOCUMENTS

| | | | |
|---|---|---|---|
| 4,773,952 | 9/1988 | Wesley, Jr. | 220/901 |
| 5,150,812 | 9/1992 | Adams | 220/901 |
| 5,468,022 | 11/1995 | Linder et al. | 283/81 |
| 5,512,352 | 4/1996 | Haig | 283/81 |
| 5,542,255 | 8/1996 | Preston et al. | 220/901 |

OTHER PUBLICATIONS

3M Data Page Product Description for "Scotchmark™ Brand White Polyester Computer–Imprintable Lablel Stocks".

3M Data Page Product Description for "3M™ Scotchmark™ 7620 White Vinyl Label Stock".

3M Data Page Product Description for "3M™ Scotchmark™ Y7878 Image Durable Ink Jet Label Stock".

Perlman, Patent Application Serial No. 08/293,016 filed Aug. 19, 1994 for "Adhesive Lagel for Microcentrifuge Tube".

Temporary Data Page Product Description for "Primalyn™ 7604FP Roll Label Stock Top–Coated White Vinyl".

*Primary Examiner*—Willmon Fridie, Jr.

*Attorney, Agent, or Firm*—Lyon & Lyon LLP

[57] ABSTRACT

A method for specimen identification is described, employing marking or printing of a label for placing on a cryogenic storage vial or other container which must withstand contact with the liquid and/or vapor phases of liquid nitrogen at a temperature of approximately −196° C. The marking or printing also resists the ice and moisture which condenses on the container when it is removed from the liquid nitrogen. The method includes the steps of providing a sized portion of a pressure-sensitive adhesive label having a waterproof thermoplastic facestock material with a markable and print-retaining waterproof upper surface and a waterproof adhesive-coated lower surface. The facestock material is capable of being stretched at room temperature at least 10% in the machine direction and at least 10% in the transverse direction without breaking, whereby the facestock and the adhesive can remain united, and also bonded to the container during and after contact with the liquid nitrogen.

12 Claims, No Drawings

STRETCHABLE THERMOPLASTIC LABELS FOR CRYOGENIC STORAGE CONTAINERS

BACKGROUND OF THE INVENTION

This invention relates to the selection and use of certain pressure-sensitive adhesive-bearing, waterproof, thermoplastic label materials for identification and marking of cryogenic containers. More specifically, the invention relates to the discovery that certain stretchable thermoplastic facestock materials can resist adhesive delamination and peeling experienced by most thermoplastic labels which have been adhered to a container and chilled to cryogenic temperatures.

Storage of perishable or unstable laboratory and industrial materials including tissue culture cells, embryos, sperm, eggs, chemicals, biochemicals and the like, at low and ultra-low temperatures, is referred to as cryogenic storage. For the purposes of this invention, cryogenic storage temperatures are defined as temperatures ranging downward from approximately −80° C. to at least −196° C. (the boiling point of liquid nitrogen), and are provided by special mechanical freezers and by special insulated Dewar chambers carrying liquid nitrogen. Temperatures as low as −270° C. are provided by Dewar chambers holding liquid helium.

Tightly sealing cylindrical vials having gasketed sealing lids, are typically fabricated from thermoplastic materials such as polypropylene and polyethylene, and are commercially available for holding samples under cryogenic storage conditions. These vials are often essential for sample storage in liquid nitrogen at −196° C., or at the same temperature in the vapor phase above liquid nitrogen. While it is possible to manually write on such round-surfaced vials and other cryogenic storage containers with permanent marking ink for purposes of sample identification, it is considerably easier to place a pre-marked or pre-printed label on such a container.

Unfortunately, the only ink-retaining materials found, intended for cryogenic labeling, are woven and non-woven fiber and cloth tapes which are difficult to write on with any degree of accuracy or convenience, and impossible to print upon using either conventional ink-jet or laser-type computer-directed printers. Examples of these commercially available materials include cloth Cryoware™ labels from the Nalge Company (Rochester, N.Y.) and "high/low temperature" cloth tape #314 from TimeMed Labeling Systems, Inc. (Burr Ridge, Ill.). One other label-associated material for cryogenic use, termed "Clear Tape", is from Bel-Art Products (Pequannock, N.J.). This product (which is not a label) withstands liquid nitrogen at −196° C., and is described as a clear protection tape for lab labels to be placed over labels to help in resisting chemicals, moisture and low temperature.

SUMMARY OF THE INVENTION

This invention features the use of a limited group of markable thermoplastic label materials for cryogenic sample identification. These label materials require no clear overwrap tape to preserve the label or markings during or following cryogenic storage. If adequately stretchable and waterproof, the pressure-sensitive adhesive labels will remain adhered to laboratory storage vials and other containers during and after immersion in liquid nitrogen by resisting freeze-fracture delamination of the adhesive and peeling of the label. Furthermore, the ability of these label materials (which typically have smooth-surfaced thermoplastic facestocks with ink-retaining top-coatings) to conveniently and accurately accept a variety of markings further distinguishes the present invention from prior art cryogenic label materials and label protection tapes.

It was found that thermoplastic label materials which can be stretched at least 10% in the machine direction (the direction of label manufacture and spooling) and at least 10% in the transverse direction (perpendicular to the direction of manufacture) without breaking will remain bonded to the adhesive material when attached to a cryogenic storage container and exposed to cryogenic storage conditions. However, even greater stretchability of the facestock can provide further improvements in maintaining the integrity of the facestock/adhesive bond. Therefore, preferably the facestock can be stretched at least 15% or more in the machine direction and at least 15% in the transverse direction.

Thus, in a first aspect, the invention features a convenient method for specimen identification, employing marking or printing of a label for placing on a cryogenic storage vial or other container which must withstand contact with the liquid and vapor phases of liquid nitrogen at a temperature of approximately −196° C. or other cryogenic conditions below about −80° C. The marking (e.g., hand-writing with ballpoint or permanent marker pen or pencil) or printing (e.g., computer-directed laser or ink-jet printing) also resist ice and moisture which condenses on the container when it is removed from the liquid nitrogen. The method includes the steps of first providing a sized portion of a pressure-sensitive adhesive label which contains a waterproof, non-polyvinyl thermoplastic facestock material with a markable waterproof upper surface and a waterproof adhesive-coated lower surface. The facestock material is capable of being stretched at room temperature at least 10% in the machine direction and at least 10% in the transverse direction without breaking. This allows the facestock and the adhesive to remain united and bonded to the cryogenic storage container during and after contact with the liquid nitrogen. In another step, either marking or printing identification is placed upon the upper surface of the facestock to identify the cryogenic storage container and any material within the container. Thus, the upper surface of the facestock material is preferably markable and print-retaining. In yet another step, the sized portion of the adhesive label is attached to the container. The step of placing the identification marking or printing, and the step of attaching the sized portion of adhesive label to the container may be performed in either order. Typically the label is attached to a sidewall of the container, however, it may be attached in other locations, for example on the top.

In preferred embodiments of the above aspect, the facestock material is capable of being stretched at room temperature at least 15%, 20%, 50%, or more in the machine direction and at least 15%, 20%, 50% or more in the transverse direction without breaking; the facestock material is a stretchable polyolefin facestock material; the facestock material is between approximately 0.001 inches and 0.010 inches in thickness; the adhesive coating on the lower surface of the facestock is selected from the group consisting of acrylic and rubber-based adhesives; the adhesive coating is between approximately 0.0005 inches and 0.005 inches in thickness; the specimen marking or printing identification on the upper surface of the facestock material is accomplished by an instrument selected from the group which includes a permanent marking pen, ballpoint pen, pencil, typewriter, computer-directed ink-jet printer, and computer-directed laser printer.

In another aspect of the invention, a kit is provided, including at least one cryogenic storage container and at least one sized portion of a pressure-sensitive adhesive label which includes a waterproof, non-polyvinyl thermoplastic facestock material with a markable and print-retaining waterproof upper surface and a waterproof, adhesive-coated lower surface. The facestock material is capable of being stretched at room temperature at least 10% in the machine direction and at least 10% in the transverse direction without breaking, allowing the facestock and the adhesive to remain united and bonded to the container during and after contact with liquid nitrogen or other cryogenic storage conditions.

In preferred embodiments, the facestock material is capable of being stretched at least 15%, 20%, 50%, or more in the machine direction and at least 15%, 20%, 50% or more in the transverse direction without breaking. Also in preferred embodiments, the facestock material is a stretchable polyolefin material.

In a related aspect, the invention provides a labeled cryogenic storage vial. The labeled vial includes a vial constructed of a material suitable for exposure to cryogenic storage conditions and a sized portion of a pressure-sensitive adhesive label attached to the vial. Similar to the aspects above, the label is made of a waterproof, non-polyvinyl thermoplastic facestock material with a markable and print-retaining waterproof upper surface and a waterproof adhesive-coated lower surface. The facestock material can be stretched at room temperature at least 10% in the machine direction and at least 10% in the transverse direction without breaking. This allows the facestock and the adhesive to remain united and bonded to the vial during and after contact with liquid nitrogen or other cryogenic storage conditions.

In preferred embodiments, the label is as described for embodiments above.

Other features and embodiments of the invention will be apparent from the following description of the preferred embodiments, and from the claims.

DETAILED DESCRIPTION OF THE PREFERRED EMBODIMENTS

As indicated in the Summary above, the present invention involves the identification of thermoplastic label materials which are suitable for use in labeling vials or containers for cryogenic storage without the need for secondary protection of the label surface or a secondary material to provide adhesion during or after the cryogenic storage condition. The invention also includes the identification of properties of the label materials which affect the integrity and adhesion of the label during exposure to cryogenic conditions.

Over ninety percent of thermoplastic label materials which were attached to polyethylene and polypropylene cryogenic storage vials for laboratory samples, and which were tested by immersion in liquid nitrogen, failed to remain attached to the vials. In most cases of failure, the lower layer of the label consisting of a high peel-strength acrylic or rubber adhesive, remains attached to the vial while the upper layer(s) of the label, consisting principally of the thermoplastic facestock material (the major structural layer of the label which carries the adhesive), detaches from the vial. In occasional cases of failure, the adhesive and the facestock material fracture as a unit from the container.

The test which was used in the present invention to define "cryogenic survival or failure" was the ability of loan adhesive labeling material to remain attached to both virgin polyethylene and virgin polypropylene laboratory storage vials during and after immersion in the liquid and the vapor phases of liquid nitrogen at −196° C. for at least one week. In analyzing most cases of cryogenic failure of thermoplastic labels with aggressive adhesives, it was found that the underside of the facestock loses all stickiness due to freeze-fracture and transfer of all adhesive to the container. However, after warming to room temperature, the thermoplastic facestock material was securely reattachable to the container via the transferred adhesive.

This observation suggests that the observed delamination of the adhesive layer during freezing is not caused by the facestock losing its affinity for binding the adhesive. The question of what causes adhesive delamination on thermoplastic facestock materials stored at cryogenic temperatures has remained unanswered for some time. The answer has seemed critical in finding a remedy in the form of one or more thermoplastic materials suitable for producing cryogenic labels.

In the process of testing many different thermoplastic label materials capable of retaining ink marking, Applicant discovered a first thermoplastic label material, which, when attached to cryogenic storage vials, survived cryogenic storage tests. This material is known as ScotchMark™ 7604FP white vinyl label stock, manufactured by the 3M Corporation (3M Identification and Converter Systems Division, St. Paul, Minn.). Labels using this material have been advertised and sold by Diversified Biotech, 1208 V.F.W. Parkway, Boston, Mass.

The technical description published by the 3M Corporation did not indicate that this label material would pass cryogenic tests on a variety of containers (plastic, glass, and metal) while most other labels showed cryogenic failure. For example, ScotchMark™ 7880, which failed cryogenic testing, is a polyester-based computer-imprintable label stock with the same rating of resistance to cold temperatures (−40° C.) as ScotchMark™ 7604FP, which passed the tests.

Searching further, it was found that ScotchMark™ 7604FP is very similar to another 3M Corp. material known as ScotchMark™ 7620. Both materials consist of a 3.5 mil thick white vinyl facestock with the same adhesive (a 1.0 mil thick 3M Corporation adhesive known as #300 High Strength Acrylic Adhesive). However, ScotchMark™ 7620 experienced repeated cryogenic failure while ScotchMark™ 7604FP again passed the tests. This observation was particularly surprising since it was inconsistent with the two-fold greater initial dynamic peel strength test result (ASTM D-3330 method ) for ScotchMark™ 7620 (74 ounces/inch on a polypropylene surface), compared to only 36 ounces/inch for ScotchMark™ 7604FP.

In a screening survey of commercially available thermoplastic label materials, a product known as ScotchMark™ Y7878 (recently developed by the 3M Corporation as their first ink jet-printable label material), was found to pass cryogenic testing on polyethylene and polypropylene vials as well as glass and metal storage containers.

The facestock material of Y7878 is very different in composition from the vinyl composition of the ScotchMark™ 7604FP (the Y7878 facestock being described by the 3M Corp. as containing a modified polyolefin composition). The ability of this polyolefin facestock material to accept and retain ink-jet printer markings as well as laser printer markings is currently unique and therefore offers an important commercial advantage over presently available vinyl facestock materials (which retain neither inkjet nor laser printer markings).

The adhesives of the 7604FP and the Y7878 materials are somewhat different, although both adhesives are acrylic and waterproof. ScotchMark™ Y7878 has a less aggressive adhesive having an initial peel strength (ASTM 3330) of 20 ounces/inch.

Surprisingly, it was found that the stretchability of the facestock correlated with suitability for cryogenic use. For example, the Y7878 label material is reasonably elastic and can be stretched approximately 15–20% in the machine direction (the direction of label manufacture and spooling) and approximately 50% in the transverse direction (perpendicular to the direction of manufacture) before breakage. During subsequent testing of the resistance of the two vinyl label materials (described above) to mechanical breakage under a stretching force, it was observed that these materials stretched to very different extents before breakage. ScotchMark™ 7604FP could be elongated approximately 50% in the "machine" direction before breaking (the direction of label manufacture and spooling) and approximately 200% in the transverse direction (perpendicular to the direction of manufacture). However, ScotchMark™ 7620 could be typically stretched less than 10% in the machine direction and 10–15% in the transverse direction before breaking. Technical data sheets from the 3M Corp. suggest that plasticizers present in ScotchMark™ 7604FP provide the high degree of elasticity in this material, allowing its use as a label on squeeze bottles, for example.

As stated earlier, most label materials, including those with aggressive adhesives, fail the cryogenic tests if the facestock materials have little elasticity, i.e., typically less than 10% elongation before breakage, e.g., ScotchMark™ 7620. Similarly, the 3M Corp. polyester-containing facestock label known as ScotchMark™ 7880 described earlier, has an aggressive adhesive (the 3M Corp. #300 High Strength Acrylic Adhesive described above), shows little measurable elongation before breakage, and peels away from all plastic, glass and metal surfaces tested at cryogenic temperatures. This ScotchMark™ 7880 product is mentioned because of its otherwise remarkable utility, withstanding many other challenging laboratory environments including direct immersion in boiling water, steam autoclaving, and moderate freezing (minus 40° C.) conditions, as described in U.S. patent application, Ser. No. 08/293,016.

Consistent with the above findings, an elasticity model and mechanism for resistance to cryogenic freeze-fracture and adhesive delamination within a thermoplastic label was developed. In order for a thermoplastic label material to remain adhesively bonded to a polyethylene or polypropylene cryogenic storage container during immersion in liquid nitrogen, the label must possess a facestock material which can be stretched in each direction (the machine and transverse directions) at room temperature, at least 10%, and preferably about 15–20% in each direction before breakage. Thus, the label material can be enlarged by stretching at room temperature to at least approximately $1.1\times1.1=1.2$, and preferably $1.2\times1.2$ or about 1.4 times its original area.

According to the model, during the rapid thermal transition from room temperature to cryogenic temperatures, a rapid volumetric contraction of the facestock of a label occurs (the major proportion of the label being facestock). Since the mass of the label is very small compared to the container to which it is attached, this volumetric contraction occurs much more rapidly for the label than for the container. Therefore, over the timespan of the label freezing and shrinking in volume, the container's dimensions will still remain relatively constant. Consequently, the adhesive area originally covered by the label will also remain relatively constant. If the label's facestock is to maintain essentially its original surface area and not split away (i.e., freeze-fracture) from its adhesive as the volume of the facestock is diminishing, the facestock must compensate by stretching horizontally in both length and width, while diminishing in its thickness.

Accordingly, to be useful in the present invention, a thermoplastic label must contain a facestock material which can adequately stretch and become thinner as it cools. These characteristics allow the label facestock material and adhesive material to remain united and connected as they become rigidly frozen into glass-like materials.

To put the above mechanism in perspective, if it were possible for a non-stretchable, (inelastic) label to remain attached to a storage container during cooling to cryogenic temperatures, the area of the label would need to decrease in coordination with the decreasing volume of the label. Given that the container cools slowly compared to the thin label, the area of the container covered by the label remains relatively constant as the label begins contracting in all directions. For the shrinking label to remain attached to the container, the label's adhesive would need to quickly move inwards toward the center of the label without fracturing.

Experimental observations on freeze-fracture indicate that fracturing rather than rapid adhesive movement generally occurs.

Having the above disclosure of the present invention, those skilled in the art will recognized that additional label materials can be identified having characteristics suitable for use in labeling vials or containers for cryogenic storage. Thus, this invention is not limited to the materials disclosed, but includes the use of other materials which have the requisite stretchability and adhesion properties.

Other embodiments of the present invention are within the following claims.

What is claimed is:

1. A method for specimen identification, employing marking or printing of a label for placing on a cryogenic storage vial or other container which must withstand exposure to cryogenic storage conditions, said method comprising the steps of:

(a) providing a sized portion of a pressure-sensitive adhesive label comprising a waterproof non-polyvinyl thermoplastic facestock material with a markable waterproof upper surface and a waterproof adhesive-coated lower surface, wherein said facestock material is capable of being stretched at room temperature at least 10% in the machine direction and at least 10% in the transverse direction without breaking, whereby said facestock and said adhesive can remain united and bonded to said container during and after said exposure to said cryogenic storage conditions;

(b) marking or printing upon said upper surface to identify said container and any material within said container, wherein said marking or printing can resist ice and moisture which condenses upon said container when it is removed from said cryogenic storage conditions; and (c) attaching said sized portion of said label to said container;

wherein said cryogenic storage conditions comprise exposure to a temperature of about −80° C. or lower.

2. The method of claim 1, wherein the cryogenic storage conditions comprise exposure to the liquid or vapor phase of liquid nitrogen.

3. The method of claim 1, wherein said facestock material is capable of being stretched at room temperature at least 15% in the machine direction and at least between 15% in the transverse direction without breaking.

4. The method of claim 1, wherein said facestock material is stretchable polyolefin facestock material.

5. The method of claim 1, wherein said facestock material is between approximately 0.001 inches and 0.010 inches in thickness.

6. The method of claim 1, wherein the adhesive coating on said lower surface of said facestock material is selected from the group consisting of acrylic and rubber-based adhesives.

7. The method of claim 6, wherein said adhesive coating is between approximately 0.0005 inches and 0.005 inches in thickness.

8. The method of claim 1, wherein said marking or printing of said upper surface of said facestock material is accomplished by an instrument selected from the group consisting of a permanent marking pen, ballpoint pen, pencil, typewriter, computer-directed ink-jet printer, and computer-directed laser printer.

9. A kit comprising at least one cryogenic storage container, and at least one sized portion of a pressure-sensitive adhesive label comprising a waterproof non-polyvinyl thermoplastic facestock material with a markable and print-retaining waterproof upper surface and a waterproof adhesive-coated lower surface, wherein said facestock material is capable of being stretched at room temperature at least 10% in the machine direction and at least 10% in the transverse direction without breaking, whereby said facestock and said adhesive can remain united and bonded to said container during and after contact with liquid nitrogen.

10. The kit of claim 9, wherein said waterproof non-polyvinyl thermoplastic facestock material is a stretchable polyolefin material.

11. A labeled cryogenic storage vial, comprising a vial constructed of a material suitable for exposure to cryogenic storage conditions having attached thereto a sized portion of a pressure-sensitive adhesive label;

wherein said label comprises a waterproof non-polyvinyl thermoplastic facestock material with a markable and print-retaining waterproof upper surface and a waterproof adhesive-coated lower surface, wherein said facestock material is capable of being stretched at room temperature at least 10% in the machine direction and at least 10% in the transverse direction without breaking, whereby said facestock and said adhesive can remain united and bonded to said vial during and after contact with liquid nitrogen.

12. The labeled cryogenic storage vial of claim 11, wherein said waterproof non-polyvinyl thermoplastic facestock material is a stretchable polyolefin material.

* * * * *